US008603269B2

(12) United States Patent
Tooker

(10) Patent No.: US 8,603,269 B2
(45) Date of Patent: Dec. 10, 2013

(54) METHOD OF FABRICATION OF CORROSION RESISTANT OIL FIELD TUBULARS

(75) Inventor: Ken Tooker, Houston, TX (US)

(73) Assignee: Energy Alloys, LLC, Houston, TX (US)

( * ) Notice: Subject to any disclaimer, the term of this patent is extended or adjusted under 35 U.S.C. 154(b) by 393 days.

(21) Appl. No.: 13/061,177

(22) PCT Filed: Sep. 4, 2008

(86) PCT No.: PCT/US2008/075274
§ 371 (c)(1),
(2), (4) Date: Feb. 28, 2011

(87) PCT Pub. No.: WO2010/024829
PCT Pub. Date: Mar. 4, 2010

(65) Prior Publication Data

US 2011/0146831 A1 Jun. 23, 2011

Related U.S. Application Data

(60) Provisional application No. 61/092,664, filed on Aug. 28, 2008.

(51) Int. Cl.
*C22F 1/10* (2006.01)
*C22C 19/03* (2006.01)
*F16L 9/00* (2006.01)

(52) U.S. Cl.
USPC ..... 148/676; 148/426; 138/177

(58) Field of Classification Search
USPC ..... 138/177; 148/676, 426
See application file for complete search history.

(56) References Cited

U.S. PATENT DOCUMENTS 4,997,040 A 3/1991 Cizek
6,315,846 B1 11/2001 Hibner et al.

FOREIGN PATENT DOCUMENTS

WO PCT/US04/0244449 12/2004
WO PCT/US05/0081968 4/2005
WO PCT/US06/0177679 8/2006

*Primary Examiner* — Jessee Roe
(74) *Attorney, Agent, or Firm* — David B. Dickinson

(57) ABSTRACT

A corrosion resistant waste-water disposal or chemical injection screen is fabricated from extruded, double cold pilgered N06625 or N07716 nickel alloy in a standard oilfield tubular length. After providing each end with a premium thread for a box and a pin end, and slotting the body of the well screen with slits no wider than 0.015 inches and no longer than 2.5 inches, the well screen is ready for deployment in a well. Other types of oilfield tubulars in standard OCTG lengths could be fabricated in the manner described herein.

11 Claims, 4 Drawing Sheets

METHOD OF FABRICATION OF CORROSION RESISTANT OIL FIELD TUBULARS

FIELD OF THE INVENTION

The present disclosure relates to corrosion-resistant tubulars for use in well bore or in other corrosive environments; specifically, to tubulars formed from either a nickel alloy N06625 or nickel alloy N07716 which is extruded, cold worked and treated (or alternatively, drilled then annealed), then machined to form oilfield tubulars in standard lengths, especially water injection screens for injecting brine filled drilling waste water or other chemicals into the geological formation.

BACKGROUND

The oil and gas industry has long sought seamless oilfield tubulars in standard sizes that can resist corrosion found in deep hot and sour wells. It would be useful and desirable to have corrosion resistant tubulars from which downhole tools and assemblies might be fabricated. Significant resources have been devoted to fabrication of such tubulars from high nickel content alloys, such as N06625, N10276 and N07716.

Any number of United States patents has been issued describing the beneficial aspects of Ni alloys in sour oil and gas applications. See for example U.S. Pat. No. 6,315,846 to Hibner et al., U.S. Pat. No. 5,217,684 to Igarashi et al., U.S. Pat. No. 4,400,210 and U.S. Pat. No. 4,400,211 to Kudo et al., U.S. Pat. No. 4,245,698 to Berkowitz et al. Other United States patents have been issued for other combinations of alloying elements including U.S. Pat. No. 6,730,264 to Cao, U.S. Pat. No. 5,556,594 to Frank et al., U.S. Pat. No. 5,310,523 to Culling, U.S. Pat. No. 5,246,661 to Culling, U.S. Pat. No. 4,985,091 to Culling, most of which sought to decrease the percentage of Ni in the combination because of the high price of this scarce raw material. Other United States patents have issued for various heat treatment processes, which seek to establish the desired physical characteristics of the material. These include U.S. Pat. No. 7,156,932 to Cao et al., U.S. Pat. No. 6,638,373 to Pike Jr. et al. and U.S. Pat. No. 3,871,928 to Smith, Jr. et al.

The corrosion resistance and physical characteristics desired for oilfield tubulars make extrusion of readily machinable tubulars difficult to accomplish. So far as known to applicant, no one has previously created a oilfield corrosion resistant seamless tubular from N06625 or N07716 nickel alloys in standard oilfield lengths; and, specifically, no one has created a waste water and drilling fluid injection screen from such alloys for use in wells to permit disposal of the produced water, or other waste products, back into the formation from which it came or to inject chemicals to pressurize the formation to aid in production or any applications where fluids or semi-solids are to be injected into or withdrawn from a down hole environment. All references will use the Uniform Numbering System method of designation of the alloy composition as prescribed by ASTM and SAE.

Although the corrosion resistant properties of nickel alloys are well known, the cost and difficulty of manufacturing seamless oilfield standard length tubulars has long been deemed insurmountable. One method of accomplishing this might be the drilling of nickel alloy bar, then cold pilgering the resultant tubular, to achieve the lengths required. While this might be possible with a portion of the teachings of this application, because of the resultant waste from the drilling process, no one would rationally try to fabricate oilfield tubulars in this manner. Applicant has overcome all of these obstacles to fashion a seamless oilfield length tubular that can be used to fabricate an injection screen for a deep hot and sour environment.

The present application contains the description of a process for making these seamless oilfield tubulars in standard lengths having both the physical characteristics of corrosion resistance and high strength required for service in deep oil and gas wells, which can be machined within high tolerances needed for modern complex down hole mechanical devices. Standard oilfield or OCTG lengths vary within narrow ranges for the two most commonly used standard oil field lengths designated the R2 which is 28-32 feet in length, and the R3 which is 38-43 feet in length. The alloy used in this method works well under both conditions and is therefore well suited to oil and gas field use. The fabrication of nickel alloys in these standard lengths has not been readily accomplished. Previous attempts to do so have resulted in tubulars so difficult to machine, most have stopped trying to do so. Having fabricated a machinable oilfield tubular out of nickel alloy as described herein, the completion of the tubular by machining can be readily accomplished.

Well screens, which have long been used to either drain or inject fluids into a well bore, are a pertinent example. The technology for the manufacture of such screens has long recognized the need to create slots, such as by cutting, which provided keystone apertures tapered in cross section. See, for example, U.S. Pat. No. 1,207,808, issued 12 Dec. 1916. Often, these keystone slots are made by cutting the surface, then compressing the exterior surface to close the slot at its exterior edge to form a lip. See also, U.S. Pat. Nos. 1,652,208, issued 13 Dec. 1927, and 2,358,873, issued 26 Sep. 1944.

Modern developments seek to improve these old methods of creating uniform spacing in the slots in smaller widths. Slots having widths between 0.015 and 0.025 inches, while for many applications preferred widths would require uniform slots of approximately 0.005 to 0.007 inches to prevent the ingress of sand particles into the tubular screen. A number of more recent patents seek to create a uniform exterior lip to each slit by a variety of techniques. See, for example, U.S. Pat. Nos. 6,112,570, issued 5 Sep. 2000; 6,898,957, issued 31 May 2005; 7,069,657, issued 4 Jul. 2006; 7,073,366, issued 11 Jul. 2006.

The techniques for making well screens with these high nickel alloy have not been successful because of the work hardening properties of these nickel alloys which makes the finished product less capable of standing up to the rigors of the deep well applications. Improper machining can lead to early stress fractures and catastrophic failures in these types of wells. Accordingly, applicant has developed a fabrication process that permits the tools, such as these screens, to be fashioned with the finished product having the physical characteristics to withstand the harsh well environment in which they are intended to be placed.

BRIEF SUMMARY OF INVENTION

Fabrication of corrosion resistant tubular having a minimum tensile strength of 65-ksi (65,000 psi) can be accomplished by selecting a nickel alloy having a mass and a longitudinal extent sufficient to create a tubular in a standard oilfield length; trepanning the billet to form a tubular; forming a hole in the longitudinal axis of said blank to create a tubular, increasing the grain size of the nickel alloy of the tubular by heating the tubular and by water quenching; cold working the tubular; heat treating by annealing and water quenching the tubular to increase a grain size of the tubular member toward ASTM Grain Size No. of 0 to permit machining; and, machining the tubular to form a final product. The blank can be either a billet, which will be extruded after trepanning, or a bar that can be drilled to form a tubular. The billet is trepanned and radius on one end to permit extrusion, then heated to thoroughly soak the billet and then extruded and immediately water quenched. Alternatively, a tubular can be formed from a nickel alloy bar which is drilled then annealed and water quenched prior to cold working. Either cold pilgering, shear forming or drawing can accomplish the cold working.

Although many nickel alloys can be used for this type of fabrication, alloys N06625 and N07716 are most preferred for this fabrication for a variety of reasons. If nickel alloy N07716 is chosen, the method for fabrication should also include the process of solution annealing and aging the tubular member after machining to obtain a strength levels of at least 110 ksi.

An annealing step at about 2050° F. for one hour, followed by a water quench, between the first pilgering and the second pilgering, allows a double pilgering process to be followed. This permits the alloys to be reduced to the oilfield preferred lengths without excessive hardening of the material from the cold working. From this material, a new article of manufacture, an oil or gas well tubular for use in corrosive, deep oil or gas wells and formed from the alloy set forth in either can be fabricated. From these tubulars fabricated as described above, a new article of manufacture, a water disposal screen for use in a deep oil and gas well can be formed from the alloys described above.

These corrosion-resistant slotted tubulars for injection of water or other chemicals into a well are formed as a tubular member fabricated from an extruded and cold pilgered corrosion resistant nickel alloy; and, provide a plurality of spaced slots each having an external opening on the outer surface of the tubular and each having an internal opening on the inner surface of the tubular greater in size than the external opening. The corrosion-resistant slotted tubular is formed from a corrosion resistant nickel alloy selected from a group of nickel alloys consisting of: N06625, N07716, N10276, N08825, N05500, N06002, N07500, N07750, N09901, N10001, N06950, N06985, N09928, and N10004. The preferred corrosion resistant nickel alloy is N06625. The corrosion-resistant slotted tubular described can provide each slot on the external surface of the tubular which is not greater than 2.50 inches long and a slot length on the internal surface of the tubular is not greater than 1.83 inches long. The corrosion-resistant slotted tubular is fabricated from a nickel alloy which can provide an ASTM grain size of no more than 2, prior to machining; and, for N07716, a grain size number of at least 4, after completion of the fabrication process. Moreover, the corrosion-resistant slotted tubular provides slots which are circumferentially evenly spaced in alternating checkerboard groups to maintain the physical integrity of the tubular. Alternatively, the corrosion-resistant slotted tubular can be fashioned with slots which are cut in a spiral pattern on the exterior surface of the tubular or in alternating groups along a perpendicular plane to the longitudinal axis of the tubular, that is, cross-cuts to the longitudinal axis or even as equidistant holes in the exterior surface of the tubular. Following industry practice, the corrosion-resistant slotted tubular—however fabricated—provides slots, or holes, on the exterior surface of each opening which is smaller than the corresponding opening on the interior surface to thereby inhibit the entry of sand into the tubular upon installation of the screen, although straight slots or holes having the same width on the exterior surface as found in the interior surface could also be fashioned without departing from the spirit of this invention.

DETAILED DESCRIPTION

The utility of using a high temperature, high strength, and corrosion-resistant tubular stock in oil and gas wells has long been realized. These alloys are often specified as raw materials for both piping and for down hole and surface tools where there inherent resistance to chloride corrosion is well recognized. The ability to produce an extruded and therefore seamless tubular structure in the lengths required for use in the oil and gas industry has eluded the industry because many of the same characteristics that make these high nickel content alloys desirable also make them difficult to extrude. The hot working of the billet resulting from the pushing a trepanned tubular member through an extrusion die system substantially changes the crystalline structure and therefore the physical characteristics of the resulting tubular member.

Figure 1:
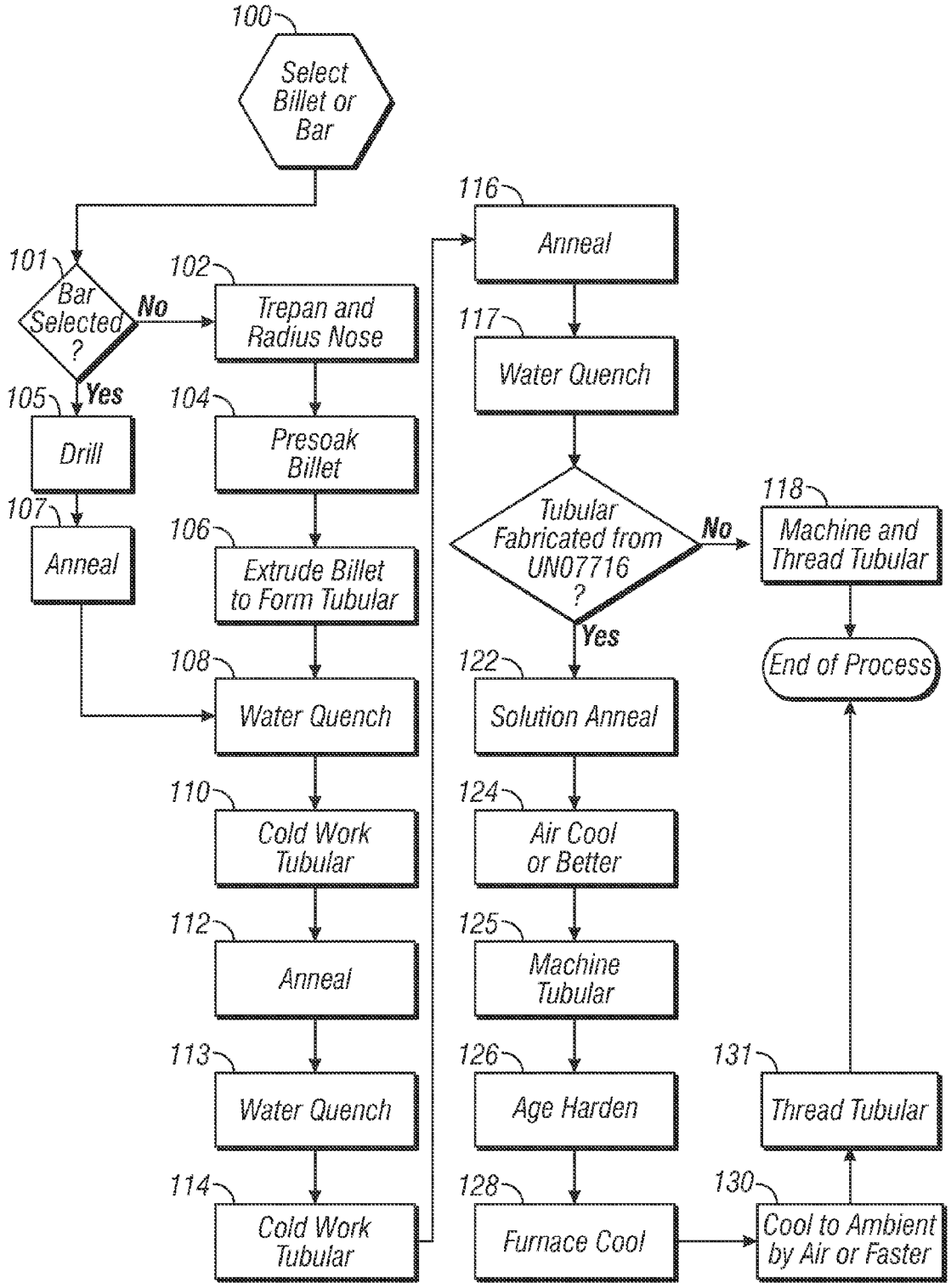
FIG. 1 is a flow diagram of the steps to fabricate a nickel alloy tubular which can be used for a well screen among other things.

Applicant has obtained a tubular member for use in corrosive oil and gas wells which has been formed to have the same characteristics of the specified UNS 06625 alloy, and therefore retain the ductility and workability of the standard alloy. As shown in FIG. 1, the method first consists of obtaining a billet or bar having sufficient mass and size to permit trepanning of the billet 100 or drilling of the bar to form a tubular blank for further proc. Ideally, all tubular members will be formed into tubular members having an outside diameter from 3½" outer diameter (OD) up to larger members, which can be as large as 13⅝" OD. Length vary within narrow ranges for two standard oil field lengths designated the R2 which can be between 28-32 feet in length and the R3 which can be between 38-43 feet in length. Billets 35" long and 12.0" OD are considered optimal for most extrusion presses available to this market. Bars to be drilled would be approximately 7½" OD solid and about 23' in length. The down hole tool of the present invention that is fabricated by the present process is a corrosion-resistant screen which is fashioned by starting with billets that are an average of 40" long and 10.9" OD (and after trepanning a 6.12"ID) that are suitable to be extruded in an extrusion press and double cold worked, in this application by pilgering, in accordance with the method described herein to form a tubular blank approximately 5½ inches OD with a 0.304 wall thickness and 34' long. The size of the finished product will dictate the size of the billet used as the starting material. These billets are cut to the appropriate length, polished on the OD, and then the billet is trepanned 102. The interior bore is polished to provide a smooth surface of 125 RMS or better and then the ends are cut and faced. One end of the billet, called the "Nose End", is radiused 102 suitably to minimize initial friction during entry of the billet into the extrusion die. Suggested hot working temperatures for these alloys is normally between 1975° F. and 2295° F. (1079-1257° C.) and no greater than 2300° F. (1260° C.) for N07716.

Figure 2:
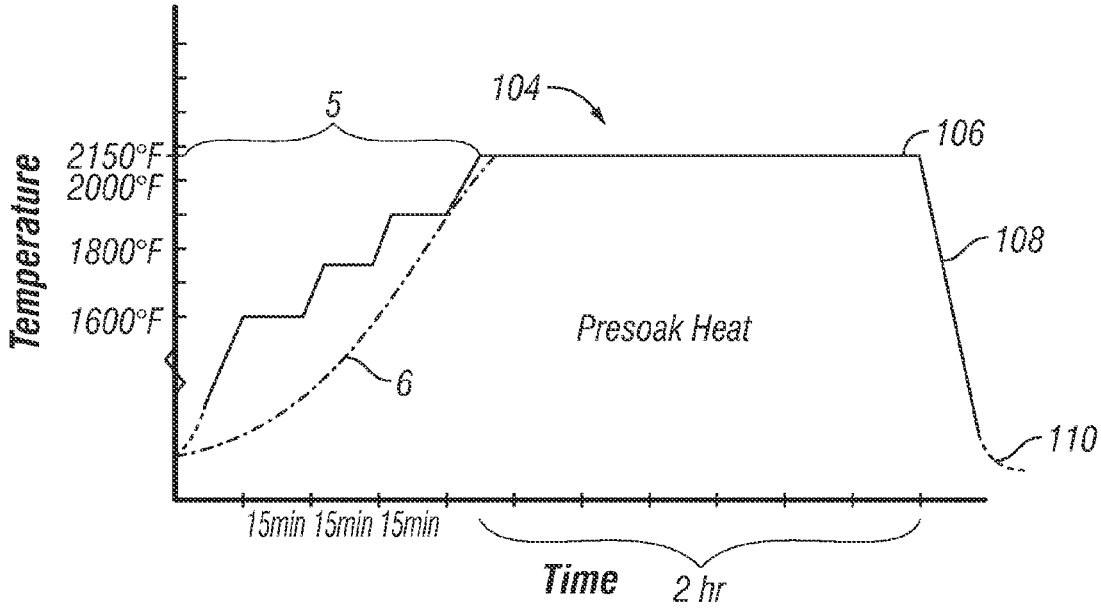
FIG. 2 is a time/temperature graph of the pre-heat of the billet prior to extrusion and the water quench which follows.
Figure 2A:
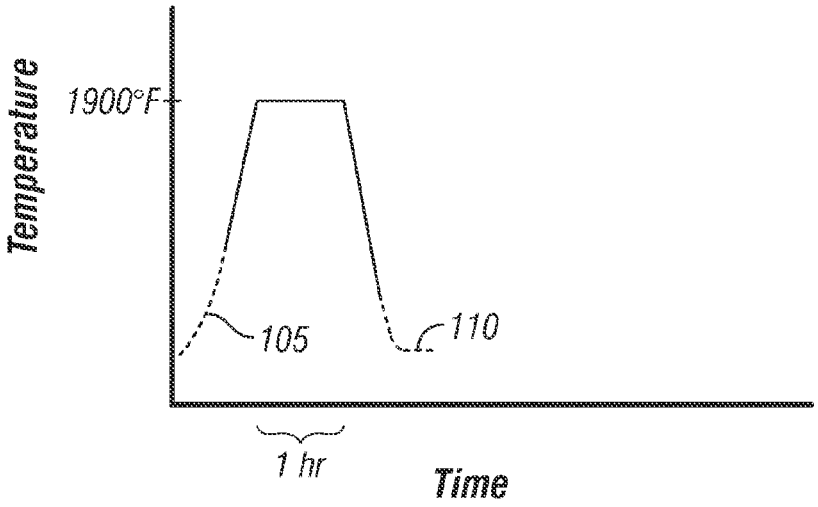
FIG. 2A is a time/temperature graph of the annealing step of the drilled bar prior to the first cold working step which follows.
Figure 3:
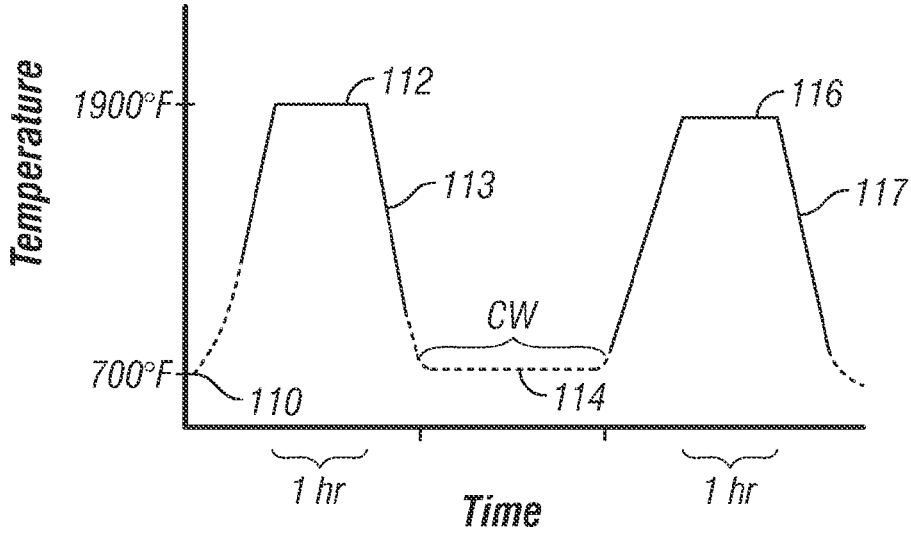
FIG. 3 is a time/temperature graph of the annealing steps on the billet after extrusion and cold working.

If the starting material is nickel alloy bar 101, the bar can be drilled immediately 105 to form a tubular blank. Although drilling is cold working of the alloy, work hardening dictates that the drilled tubular be annealed 107 and water quenched 108, prior to additional cold working 110 such as by pilgering, shear forming or drawing to increase the length of the tubular to the required standard length. FIG. 2A shows the temperature/time profile of this pre-cold working annealing step, which seeks to anneal the drilled bar for about one hour a temperature between 1900° F. and 2050° F. (1038-1121° C.) From this step forward, each process follows the same procedure to form the finished tubular good described below. The preferred method for forming these tubulars is by extrusion. It is believed the waste of nickel alloy from the drilling step will make this alternative commercially unfeasible.

At the end of the extrusion process 106 for the desired 5½" OD, the tubular for this size is approximately 7.5" OD with a 0.750" wall thickness. After extrusion 106, as further shown in FIG. 1, the billet/tubular is water quenched 108. The tubular is then cold worked by pilgering for the first time 110. This cold working 110 reduces the tubular to a 6.375" OD with a 0.500" wall thickness.

The tubular is then annealed 112 to soften the tubular for further cold working 114 after another water quench step 113. Prior to extrusion, the billet is presoaked at a heat sufficient to facilitate extrusion and to lower the grain size of the billet. This pre-soak can be done either in an induction furnace or an atmospheric furnace. As shown in FIG. 2, temperatures in the induction coil furnace 5 are increased in stages with engineered hold times to ensure uniform temperatures from the core of the billet to its surface. Temperature in the atmospheric furnace 6 is increased to near the set point temperature when the time for the soak is started. Irrespective of the type of furnace used, each trepanned tubular billet is then uniformly heated 104 to about 2150° F. prior to the extrusion process. Preferably, the billet provided to commence this process is sufficient to provide a completed tubular member between 3½" outer diameter to 13⅝" outer diameter and lengths between 28 feet and 43 feet, having a grain size of 3 or finer, to facilitate the fabrication of a fine grained, high strength alloy after extrusion, cold working and machining. It should be noted that although the present invention is fabricated by double cold pilgering of the tubular, cold working can be accomplished by other well-recognized techniques such as shear forming, or by cold drawing. These techniques are all well known to those in the metal fabrication industry.

When pre-heated using an induction coil furnace as previously stated, the billet is heated prior to extrusion in a staged fashion 5 as more fully shown in FIG. 2. The billet is heated to 1600° F. (871° C.) and held there for fifteen (15) minutes, then it is further heated in 100 to 200° F. (37-93° C.) steps and held at each plateau (i.e. 1800° F. and 1900° F.) for fifteen minutes until it is finally heated to 1900-2150° F. (1038-1177° C.) where it is soaked for two hours prior to extrusion to permit uniform heating of the entire billet. When preheated in an atmospheric furnace, the furnace is brought slowly up to 1900-2150° F. and monitored by a contact or embedded thermocouple. When the billet temperature reaches 25° F. below the set point temperature for the specific type of furnace, time is monitored and the billet is held at temperature for at least 1-hour minimum. It should be noted that times at temperature can be adjusted based on specific furnace characteristics.

The billet is then extruded 106 at an extrusion speed of no more than 120"/min. The extruded billet, now the starting material for the seamless tubular, is then immediately water quenched 108 to stop further crystalline changes that may tend to harden the tubular at these elevated temperatures prior to cold working 110. This cold working increases the hardness of the tubular so the tubular is then annealed at 1900-2050° F. for one (1) hour minimum 112 to re-achieve an ASTM grain size no more than 2, with an ASTM grain size of 0 being most preferred followed by an immediate water quench 113. Because of the physical limitations of current cold working systems, a second cold working pass 114 is made to reduce the tubular to its final configuration; that is, the preferred embodiment for use as a corrosion resistant screen fabricated from a 5½" OD with 0.304" wall thickness tubular having a length of 34'. Once the tubular has undergone the final cold working to obtain the desired size, the tubular member is again annealed 116 at 1900-2050° F. (1038-1121° C.) for (1) hour minimum followed by an immediate water quench 117 to achieve a grain size to facilitate machining. As previously noted, the ASTM grain size should be a minimum of 2 with zero being most preferred to facilitate machining.

The tubular is then ready for machining and threading to be fabricated into its final useable configuration. In the preferred embodiment, a corrosion resistant water injection screen is desired. Other down hole tools or tubulars could find this process useful in the fabrication of packers, hangers, OCTG (oil country tubular goods) tubulars or the like, which might be exposed to corrosive environments when in placed in the well bore.

The same steps are used to take alloy N07716 to the stage where it could be used to form a useful tubular or down hole tool having a higher strength rating than N06625. While alloy N07716 obtains some strength through cold working, because of subtle differences from the chemistry of N06625, thermal process can be applied to achieve the desired 110-ksi minimum yield strength making the tubular member suitable for down hole applications where higher strength materials is required.

After the N07716 tubular member has undergone the various processes of cold working and annealing described for alloy N06625 above, the N07716 tubular is solution annealed 122 at 1875-1925° F. (1024-1053° C.) for ½ hour minimum time at temperature, then cooled 124 at a rate of air cooling or faster, such as by water quench 123. If slotting is required with this material, slots would be cut or otherwise machined into the tubular 125 as will be described hereafter in the exterior wall of the tubular. Solution annealing and machining the tubular made from N07716 is followed by age hardening 126 at 1310-1455° F. (710-791° C.) from 4-12 hours time at temperature, furnace cooled 128 to 1130-1275° F.

(610-691° C.) for 4-12 hours and cooled to room temperature 130 at a rate equivalent to air cooling or by a water quench 129. Threading 131 of the hardened N07716 can be accomplished after the age hardening and cooling steps because of the well-known characteristics of this type of equipment.

If N07716 is only to be used solely for a down hole corrosion resistant tubular, the machining step 125 can be skipped without departing from this invention. The tubular will have all of the corrosion resistant characteristics and the strength to provide oilfield service in harsh environments.

After thermal processing, the tubular member will display the following strength characteristics:

Minimum Ultimate Tensile Strength 150,000 psi (1034 MPa)
Yield Strength 120,000-140,000 psi (827-965 MPa)
Minimum Elongation 20%
Minimum Reduction of Area 35%
Maximum Hardness 43 HRC
Min. Average Charpy Impact Strength 35 ft-lbs (47 J)
Min. Single Value Charpy Impact Strength 32 ft-lbs (43 J) at or near the surface It is also believed that the following alloys can also be used for the fabrication of oilfield length tubulars as described herein: N06625, N07716, N10276, N08825, N05500, N06002, N07500, N07750, N09901, N10001, N06950, N06985, N09928, and N10004.

The oilfield tubulars described above, fabricated from alloys N06625 and 07716 provide a new resource for the oil and gas industry. Specific applications can be readily recognized from the steps described previously. The manufacture of corrosion-resistant screens provides an apt use for these standard length tubulars. As previously noted, well screens are well known in the oil and gas industry. There are no known wastewater disposal screens, designed specifically for their corrosion resistance, that have been fabricated out of nickel alloy, and specifically none are known to have been fabricated from alloy N06625 or N07716 in standard oilfield lengths. For the purposes of injecting chemicals and brines back into wells, there has long been a need for a corrosion resistant well screen that can survive both the corrosive effects of the solutions being pumped back into a well for disposal as well as the heat and abrasiveness of the materials being pumped in the solution. Water disposal in large oilfield drilling programs can run in the millions of dollars each year if the waste water needs to be shipped off location from a remote well site for disposal. The oil and gas industry has long ago started reliance upon water well injections into appropriate stratigraphic zones to dispose of this hazardous waste water. The technology to isolate a suitable water zone with permanent packers is well known in the industry. Once the zone is isolated, waste water is pumped into the zone from the surface and through the screen of the present invention. These screens are fabricated in standard oilfield tubular lengths, between 30 and 40 foot lengths.

Each end is threaded to permit the screens to be assembled at the well site in a manner used to connect all drill string members. Since galling of the thread surface is a problem with these nickel alloy materials, premium threads are the preferred method of completing the well screen for connection with each other and the tubulars used to move the well screen into place adjacent the water zone. Common preferred sizes for tubulars in well screen applications would therefore be 4½" OD×0.271 wall thickness, 5½" OD×0.304 wall thickness, 5½" OD×0.415 wall thickness or 6⅝"OD×0.352 wall thickness, although other sizes could be fabricated without departing from the spirit or intent of this disclosure.

Because these well screens are inserted into deviated wells and must traverse substantial turns and doglegs to be properly inserted, the screen must be able to withstand substantial torsional and axial bending forces. Consequently, the design and placement of the slots that tend to weaken the strength of the tubular material must be completed with a view to the expected forces the screens might encounter in deployment.

Because, in some cases, the slots in each row are less than 0.015 inches, care must be exercised in the delivery and installation of the well screen at the job site. Thread protectors and delivery boxes should be used to prevent blows to the tubular wall that could close these slits. Pipe pickup and laydown machines should be utilized to install these well screens in the derrick prior to installation to prevent dragging the well screen up through the pipe door.

Figure 5:
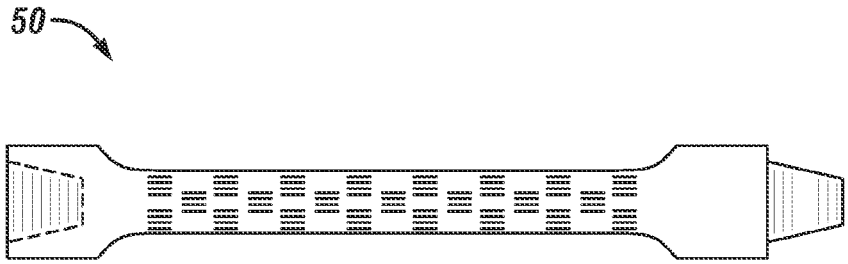
FIG. 5 is perspective view of one embodiment of water disposal screen fabricated by the process of the present invention.

FIG. 5 shows a typical water disposal screen joint. The slot pattern on these screens can vary based upon the sieve action required by the formation into which the waste water is to be injected, but in the embodiment shown herein, no more than 33 slots per axial column around the screen are cut and no more than 144 columns per screen joint, suggesting that, if more than 4,752 slots are cut on any screen joint, N07716 at the higher strength level should be used to maintain material strength integrity. The preferred embodiment shown herein is fabricated with width of each slot is 0.016 inch before machining to close the slot to 0.015 or less. In a 13 meter long screen joint, a meter at each end is provide for makeup and pipe handling and 11 meters remains for the slotting. It is estimated that a 5½", 17.0 lb/ft, tubular water injection screen made from the N06625 material will have a yield strength of 80,000 psi, and a tensile strength of 122,000 psi. This suggests that the screen will have a pull load in excess of 305,000 lbs., a compression load factor of 195,000 lbs, a torque rating of 18,000 ft/lbs and a 4,000 ft/lbs bending moment. Each screen has a calculated collapse pressure of 5,950 psi and a burst pressure of 7,075 psi. With these physical characteristics, these water injection screens will be able to long and trouble free service to the oil industry. As previously noted, if higher strengths are required, alloy N07716 will be substituted in place of the N06625 without departing from the spirit or intent of this invention.

Figure 6:
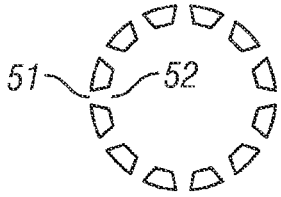
FIG. 6 is a cross-sectional view of the screen through showing another form of an embodiment of a staggered slot arrangement of the screen fabricated by this process.

FIG. 6 shows a typical cross sectional view of the inverted keystone shape of the slit. The outside diameter is less than the inside diameter of the slit. Preferably, the width of the OD is less than 0.015 inches, while the ID is 0.025 inches or greater. This permits sand to be blocked from ingress into the interior of the screen and is self-cleaning because of the flux pressure of the waste water as it is injected into the disposal zone.

Figure 4:
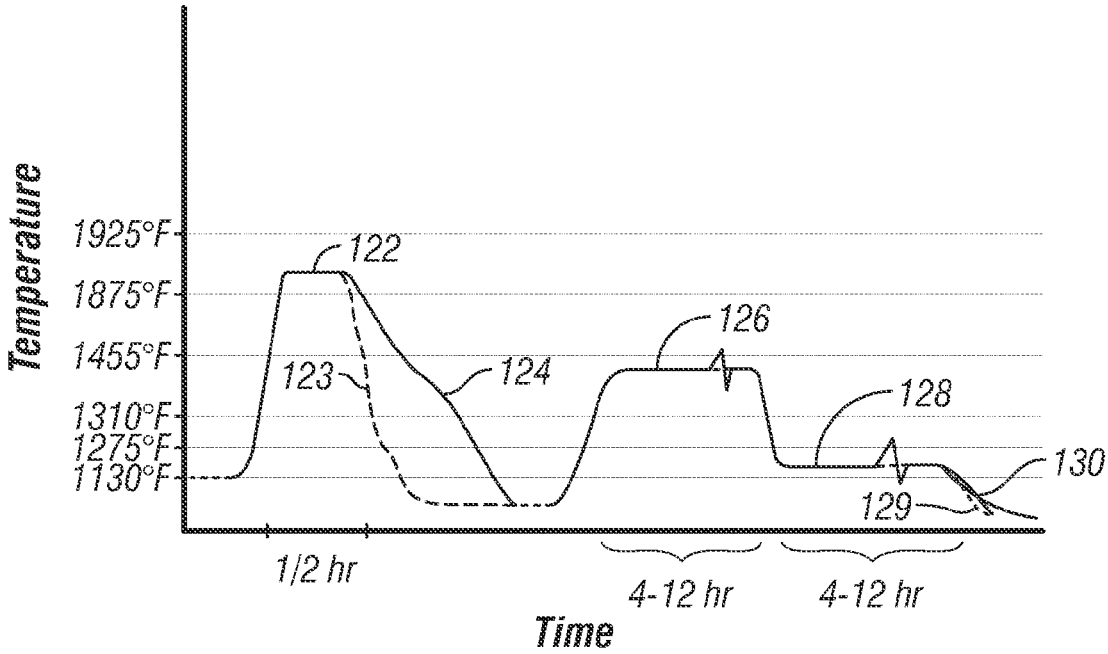
FIG. 4 is a time/temperature graph of the solution annealing and age hardening steps performed on alloy N07716 to permit machining and hardening of the tubular.

Most processes for the formation of this lip constitute cold working the outer surface of the tubular with a roller to flatten or close the lip to form the keystone shape. This cold working step can be accomplished after the second annealing. If no more than a 65-ksi well screen is desired, no further processing is required for N06625 alloy screens. If a higher minimum yield strength of about 110-120-ksi is desired, the use of N07716 alloy to form the screen must be finished with the heat-treating previously described above. After the N07716 tubular member has undergone the same processes of cold working and annealing that N06625 has received, the tubular is solution annealed 122 at 1875-1925° F. (1024-1052° C.) for ½ hour minimum time at temperature, then cooled 124 either by air or quenching. See FIG. 4 for a complete time and temperature profile of this annealing and age hardening process. Any slotting 125 to be done to this alloy product is accomplished at this point of the process. The screen is then age hardened 126 at 1310-1455° F. (710-791° C.) from 4-12 hours, then furnace cooled 128 to 1130-1275° F. (610-691° C.) for 4-12 hours and finally cooled to room temperature 130 at a rate equivalent to air cooling. After this last step, the screen should exhibit the strength characteristics desired. Slotting can be accomplished by cutting, such as by a plurality of carbide blades in accordance with techniques now practiced in this industry; or by water and abrasive blasting, or with electric arc, gas torch, or laser cutter systems, all without departing from the spirit or intent of this application.

Figure 7:
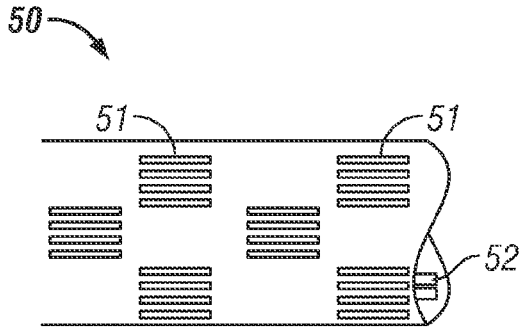
FIG. 7 is a detailed partial view of the tool showing the staggering of the slots, of yet another embodiment of a screen with typical slot design, in the exterior surface of the screen fabricated by this process.

FIG. 7 is an alternative closer view of the embodiment shown in FIG. 5 of the slits on the exterior surface of the screen 50 showing a staggering of slits on the screen. Exterior slit size 51 will be smaller in width than the interior slit size 52 after cold working of the exterior to close the slits on the exterior surface.

Figure 8:
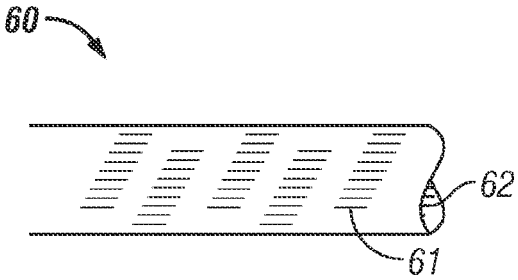
FIG. 8 is a detailed partial view of another embodiment of a water injection screen showing spiraling slots in the exterior surface of the screen fabricated by this process.

FIG. 8 discloses yet another embodiment of the slits on the exterior surface of the screen 60 showing a spiraling pattern of slits 61 on the exterior of the screen and providing, again, enlarged slits 62 on the interior of the screen.

Figure 9:
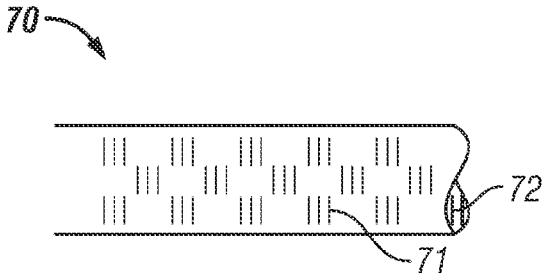
FIG. 9 is a detailed partial view of yet another embodiment of a water injection screen showing alternating transverse slots in a water injection screen fabricated by this process.

FIG. 9 discloses a third pattern of slits 71 formed on the exterior of the screen 70 in a pattern horizontal to the longitudinal axis of the well screen. As with all other slit designs, the interior slit 71 provides a small width than the interior corresponding slit 72 to prevent the ingress of sand into the interior of the screen.

Figure 10:
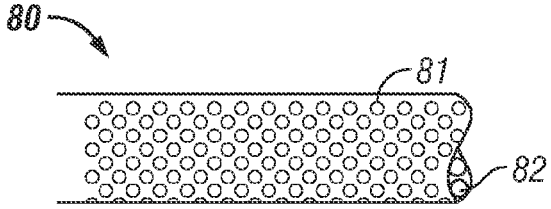
FIG. 10 is a detailed partial view of a still further embodiment of a screen showing circular openings in the exterior surface of the tubular fabricated by this process.

FIG. 10 discloses a fourth pattern of holes 81 in a screen 80. This screen also similarly exhibits interior width of each hole 82 greater than the width of corresponding exterior opening to the hole 81.

The present invention is applicable to the production of seamless oil field tubulars in standard lengths to be used in high temperature, highly corrosive environments. A screen for injecting corrosive solutions into the formation is described and claimed herein, although other tools may be readily adopted to have the same characteristics using the same tubular stock. Although the present invention is described conjunction with a description of the preferred steps for fabricating this injection screen using this method, it should be understood that modifications and variations may be used without departing from the spirit or the scope of the invention, as those skilled in the art will readily understand. Such modifications and variations are considered to be within the scope of the invention and the invention is only limited by the express language of the claims set forth below.

What is claimed is:

1. A method of fabrication of corrosion resistant tubular having a minimum tensile strength of 65-ksi comprising:

selecting a low-cobalt, non-ferromagnetic nickel alloy blank selected from a group of nickel alloys consisting of: N06625, N07716, and N06985, having a mass and a longitudinal extent sufficient to create a tubular in a standard oilfield length;

forming a hole in the longitudinal axis of said blank to create a tubular;

increasing the grain size of the low-cobalt, non-ferromagnetic nickel alloy of the tubular by heating the tubular and by water quenching;

cold working the tubular;

heat treating by a non-oxidizing annealing and water quenching the tubular to increase a grain size of the tubular member toward ASTM Grain Size No. of 0 to permit machining; and, machining the tubular to form a final product.

2. The method of claim 1 wherein the low-cobalt, non-ferromagnetic nickel alloy blank is a billet to be extruded.

3. The method of claim 2 wherein the forming comprises the additional steps of trepanning and radiusing the nose of the billet, then heating the billet to achieve a saturated billet and extruding to form a tubular.

4. The method of claim 1 wherein the low-cobalt, non-ferromagnetic nickel alloy blank is a bar to be drilled.

5. The method of claim 4 wherein the forming process comprises the additional steps of drilling the bar to form a tubular, then annealing the tubular to permit further cold working of said tubular.

6. The method of claim 1 wherein the low-cobalt, non-ferromagnetic nickel alloy blank is a spin-pierced billet.

7. The method of claim 1 wherein the cold working is cold pilgering.

8. The method of claim 1 wherein the cold working is shear forming.

9. The method of claim 1 wherein the cold working is drawing.

10. The method of claim 1 wherein the step of cold working is accomplished by two passes having an annealing step at about 2050° F. for one hour, followed by a water quench, said annealing and water quench completed between the first cold working step and the second cold working step.

11. The method of claim 10 comprising the further step of solution annealing and aging the tubular member after machining to obtain desired strength levels of at least 110 ksi.

* * * * *